US008657285B2

(12) United States Patent
Matsuoka et al.

(10) Patent No.: US 8,657,285 B2
(45) Date of Patent: Feb. 25, 2014

(54) SHEET TRANSPORT APPARATUS AND SHEET TRANSPORT METHOD

(75) Inventors: Hiroki Matsuoka, Kahoku (JP); Kazuya Mizukami, Kahoku (JP); Yoshikazu Morita, Kahoku (JP)

(73) Assignee: PFU Limited, Ishikawa (JP)

( * ) Notice: Subject to any disclaimer, the term of this patent is extended or adjusted under 35 U.S.C. 154(b) by 0 days.

(21) Appl. No.: 13/544,615

(22) Filed: Jul. 9, 2012

(65) Prior Publication Data

US 2013/0069299 A1 Mar. 21, 2013

(30) Foreign Application Priority Data

Sep. 20, 2011 (JP) ..... 2011-204709

(51) Int. Cl.
*B65H 7/02* (2006.01)

(52) U.S. Cl.
USPC ..... 271/265.04; 271/262; 271/263

(58) Field of Classification Search
CPC .... B65H 7/125; B65H 7/12; B65H 2511/524; B65H 2511/13
USPC ..... 271/258.01, 259, 262, 265.01, 265.02, 271/265.04, 298, 303
See application file for complete search history.

(56) References Cited

U.S. PATENT DOCUMENTS 5,683,079 A * 11/1997 Ebrahimi ..... 271/258.01
6,053,495 A * 4/2000 Hara et al. ..... 271/263
6,804,473 B2 * 10/2004 Nakamura et al. ..... 399/16
7,048,272 B2 * 5/2006 Lay et al. ..... 271/225
7,270,325 B2 * 9/2007 Sano et al. ..... 271/262
7,331,578 B2 * 2/2008 Sano et al. ..... 271/262
7,404,559 B2 * 7/2008 Yoshimura et al. ..... 271/263
7,654,522 B2 * 2/2010 Tonami ..... 271/262
7,673,875 B2 * 3/2010 Motohashi et al. ..... 271/263
7,934,722 B2 * 5/2011 Namikawa ..... 271/265.04
8,272,639 B2 * 9/2012 Simonis et al. ..... 271/262
2004/0150155 A1 * 8/2004 Okitsu et al. ..... 271/262
2006/0145412 A1 * 7/2006 Tagawa et al. ..... 271/258.01
2006/0244196 A1 * 11/2006 Hoenich et al. ..... 271/118
2008/0036139 A1 * 2/2008 Reyner et al. ..... 271/262
2008/0088084 A1 * 4/2008 Shimazaki ..... 271/262
2008/0203654 A1 * 8/2008 Chujo et al. ..... 271/262
2009/0057995 A1 * 3/2009 Murakami et al. ..... 271/262
2011/0079953 A1 * 4/2011 Ishii et al. ..... 271/262
2011/0238423 A1 * 9/2011 Schaertel et al. ..... 704/270
2012/0025458 A1 * 2/2012 Simonis et al. ..... 271/262

FOREIGN PATENT DOCUMENTS

JP 05-193786 8/1993

* cited by examiner

*Primary Examiner* — Kaitlin Joerger
(74) *Attorney, Agent, or Firm* — Christie, Parker & Hale, LLP

(57) ABSTRACT

Provided are a sheet transport apparatus and a sheet transport method preventing false detection of multiple feeding when feeding sheets of different thicknesses. The sheet transport apparatus includes an ultrasonic sensor including an ultrasonic transmitter and an ultrasonic receiver disposed opposite each other across a sheet transport path, a type detector for discriminating between a first sheet and a second sheet thicker than the first sheet while one or the other of the sheets is being fed along the transport path, and a multiple feed detector for detecting the presence or absence of multiple feeding of sheets along the transport path, based on an output produced by the ultrasonic sensor and on a detection result supplied from the type detector.

9 Claims, 9 Drawing Sheets

SHEET TRANSPORT APPARATUS AND SHEET TRANSPORT METHOD

CROSS-REFERENCE TO RELATED APPLICATIONS

This application is based upon and claims the benefit of priority of the Japanese Patent Application No. 2011-204709, filed on Sep. 20, 2011, the entire contents of which are incorporated herein by reference.

TECHNICAL FIELD

Embodiments described in the present specification relate to a sheet transport apparatus and a sheet transport method.

BACKGROUND

A sheet transport apparatus is known that uses an ultrasonic double feed detection method to detect the feeding of multiple sheets. In the ultrasonic double feed detection method, a threshold value common to all types of sheets is computed in advance and, when starting a document feed unit, this threshold value is automatically set in a detection pulse-height level setting circuit contained in a control unit and is used to detect whether the number of sheets fed out of the document feed unit is more than one.

Related art is disclosed in Japanese Laid-open Patent Publication No. 5-193786.

SUMMARY

When using an ultrasonic sensor to detect whether a single sheet is being fed or multiple feeding has occurred, the output level of the ultrasonic sensor varies depending not only on the number of sheets but also on the thickness of the sheet. As a result, the feeding of a thick sheet such as a card, for example, may be erroneously detected as multiple feeding of paper sheets. An object of the apparatus and method disclosed herein is to prevent false detection of multiple feeding when feeding sheets of different thicknesses.

According to an aspect of the embodiment, a sheet transport apparatus is provided. The sheet transport apparatus includes an ultrasonic sensor including an ultrasonic transmitter and an ultrasonic receiver disposed opposite each other across a sheet transport path, a type detector for discriminating between a first sheet and a second sheet thicker than the first sheet while one or the other of the sheets is being fed along the transport path, and a multiple feed detector for detecting the presence or absence of multiple feeding of sheets along the transport path, based on an output produced by the ultrasonic sensor and on a detection result supplied from the type detector.

According to another aspect of the embodiment, a sheet transport method is provided. The sheet transport method includes detecting an output of an ultrasonic sensor, the ultrasonic sensor including an ultrasonic transmitter and an ultrasonic receiver disposed opposite each other across a sheet transport path, distinguishing the type of sheet being fed along the transport path, by using a type detector which discriminates between a first sheet and a second sheet thicker than the first sheet while one or the other of the sheets is being fed along the transport path, and detecting the presence or absence of multiple feeding of sheets along the transport path, based on a detection result of the output of the ultrasonic sensor and on an distinction result supplied from the type detector.

According to the apparatus and method disclosed herein, false detection of multiple feeding is prevented that may occur when feeding sheets of different thicknesses.

The object and advantages of the invention will be realized and attained by means of the elements and combinations particularly pointed out in the claims. It is to be understood that both the foregoing general description and the following detailed description are exemplary and explanatory and are not restrictive of the invention, as claimed.

DESCRIPTION OF EMBODIMENTS

1. Hardware Configuration

Figure 1:
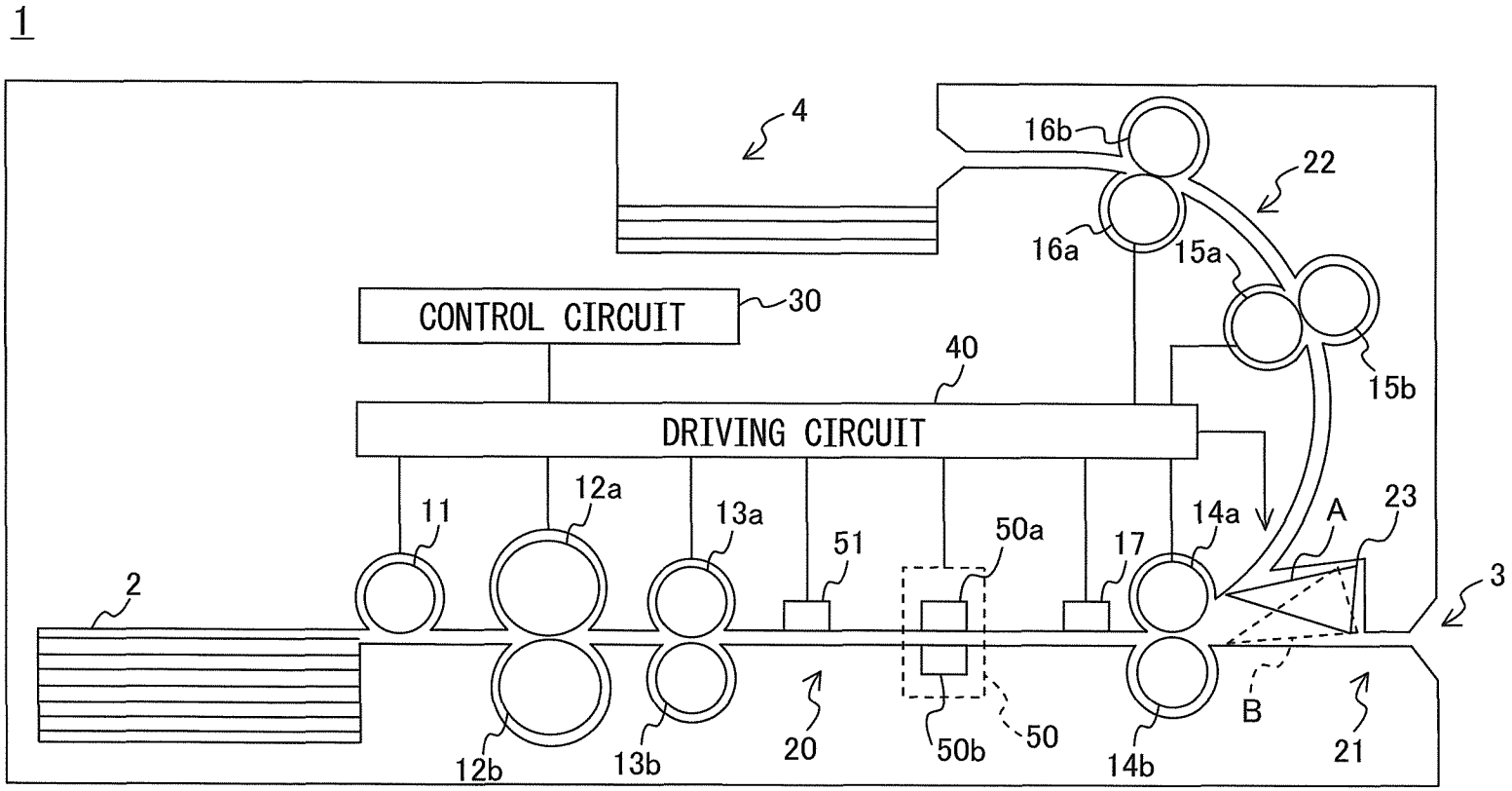
FIG. 1 is a diagram schematically illustrating a configuration example of a document reading apparatus.

Embodiments will be described below with reference to the accompanying drawings. FIG. 1 is a diagram schematically illustrating a configuration example of a document reading apparatus. In the present embodiments, the sheet transport apparatus for transporting sheet-like media is implemented in the form of a document reading apparatus which transports documents and reads an image of each document with an image sensor. The sheet transport apparatus can be implemented not only as a document reading apparatus but also as a copying apparatus, printing apparatus, sheet processing apparatus, card processing apparatus, or any other apparatus that handles sheet-like media.

The document reading apparatus 1 includes a document feed unit 2, a first document output tray 3, a second document output tray 4, a take-up roller 11, separation rollers 12*a* and 12*b*, and transport rollers 13*a* and 13*b*, 14*a* and 14*b*, 15*a* and 15*b*, and 16*a* and 16*b*. The document reading apparatus 1 further includes a first transport path 20, a straight transport path 21, and a curved transport path 22 for transporting documents therealong. Document sheets taken by the take-up roller 11 from the document feed unit 2 are separated one by one by the separation rollers, and fed into the first transport path 20 one sheet at a time. When the document being fed along the first transport path 20 reaches the transport rollers 14*a* and 14*b*, the transport path branches out into two paths, the straight transport path 21 that leads to the first document output tray 3 and the curved transport path 22 that leads to the second document output tray 4.

The curved transport path 22 guides the document along the curved path into the second document output tray 4 provided in the upper part of the document reading apparatus 1. On the other hand, when the document is a relatively stiff card-like document, the document is guided along the straight transport path 21 and allowed to output at the first document output tray 3, thus preventing damage to the transport mechanism.

A path switching unit 23 is provided where the path branches between the straight transport path 21 and the curved transport path 22. The path switching unit 23 switches the document transport path between the straight transport path 21 and the curved transport path 22 by mechanical means. For example, when the path switching unit 23 is in position A, the document is fed into the straight transport path 21, and when the path switching unit 23 is in position B, the document is fed into the straight transport path 22.

The document reading apparatus 1 further includes an image sensor 17, a control circuit 30, and a driving circuit 40. The image sensor 17 generates an electrical signal by capturing an image of the document being fed along the transport path. The control circuit 30 has the function of generating a document image based on the detection signal supplied from the image sensor 17, as well as the function of controlling the operation of the take-up roller 11, the separation rollers 12*a* and 12*b*, the driving transport rollers 13*a*, 14*a*, 15*a*, and 16*a*, and the path switching unit 23. The driving circuit 40 drives the rollers 11, 12*a*, 12*b*, 13*a*, 14*a*, 15*a*, and 16*a*, the path switching unit 23, and the image sensor 17 under the control of the control circuit 30.

The document reading apparatus 1 also includes an ultrasonic sensor 50 and a second sensor 51. The ultrasonic sensor 50 includes an ultrasonic transmitter 50*a* and an ultrasonic receiver 50*b*. The ultrasonic transmitter 50*a* and the ultrasonic receiver 50*b* are disposed opposite each other across the first transport path 20. The ultrasonic sensor 50 and the second sensor 51 are both driven by the driving circuit 40 under the control of the control circuit 30. Detection results from the ultrasonic sensor 50 and the second sensor 51 are read into the control circuit 30 via the driving circuit 40. The second sensor 51 will be described in detail later in connection with each relevant embodiment. The arrangement of the rollers may be varied according to how the document reading apparatus 1 is embodied, and is not limited to the above specific arrangement. For example, the transport rollers 13*a* and 13*b* may be disposed on the downstream side of the ultrasonic sensor 50.

Figure 2:
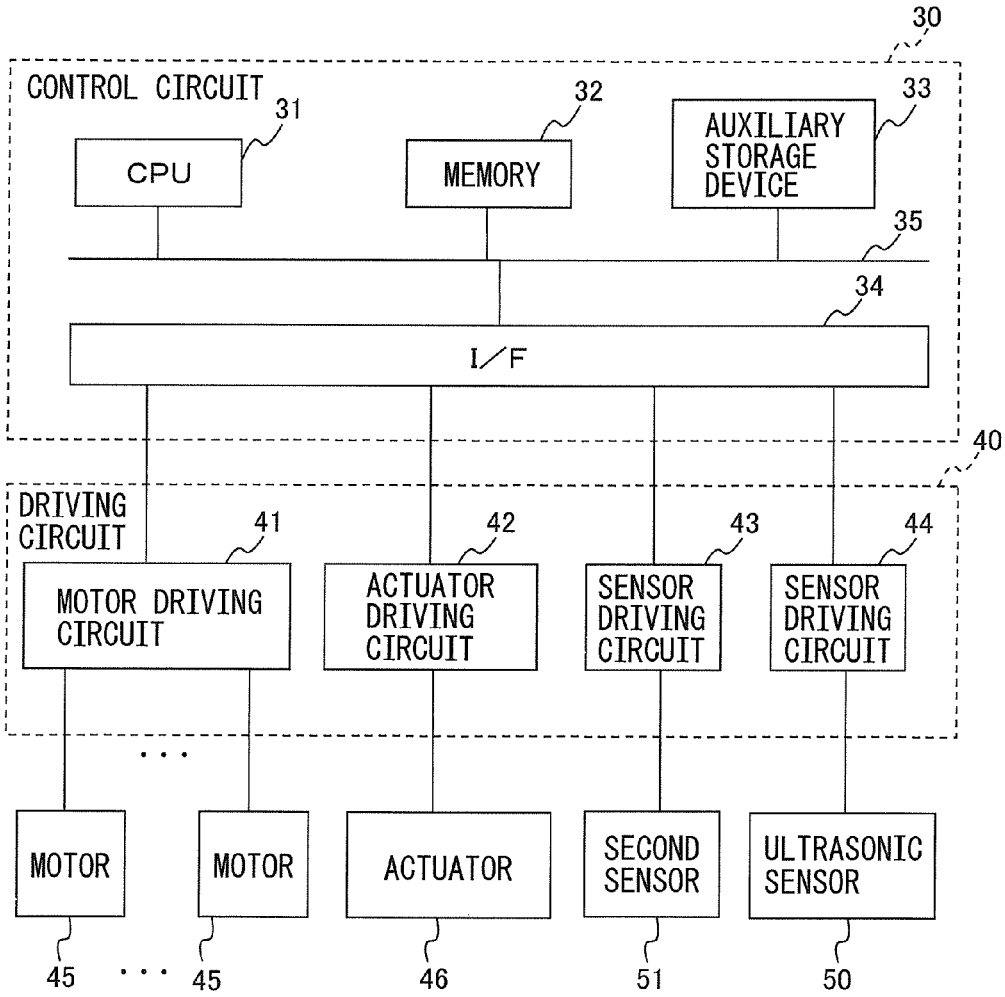
FIG. 2 is a diagram illustrating a configuration example of a control circuit and driving circuit.

FIG. 2 is a diagram illustrating a configuration example of the control circuit 30 and driving circuit 40. The control circuit 30 includes a CPU (Central Processing Unit) 31, a memory 32, an auxiliary storage device 33, an interface circuit 34, and a bus 35. In the attached diagram, the interface circuit is designated "I/F". The CPU 31, the memory 32, the auxiliary storage device 33, and the interface circuit 34 are electrically interconnected via the bus 35.

By executing computer programs stored in the auxiliary storage device 33, the CPU 31 performs an image generation process based on the document image captured by the image sensor 17 and a process of multiple document feed detection to be described later. The auxiliary storage device 33 may include a nonvolatile storage device, read only memory (ROM), or hard disk for storing such computer programs.

The memory 32 stores the program currently being executed by the CPU 31 and data temporarily used by the program. The memory 32 may include a random access memory (RAM). The CPU 31 supplies control signals to the driving circuit 40 via the interface circuit 34, and receives output signals from the various sensors 17, 50, and 51 via the driving circuit 40.

The driving circuit 40 includes a motor driving circuit 41, an actuator driving circuit 42, and sensor driving circuits 43 and 44. Under direction of the control circuit 30, the motor driving circuit 41 drives motors 45, . . . , 45 which provide rotational driving forces to the respective rollers 11, 12*a*, 12*b*, 13*a*, 14*a*, 15*a*, and 16*a*. On the other hand, the actuator driving circuit 42 operates an actuator 46 for driving the path switching unit 23 under direction of the control circuit 30, and switches the path between the straight transport path 21 and the curved transport path 22.

Figure 3:
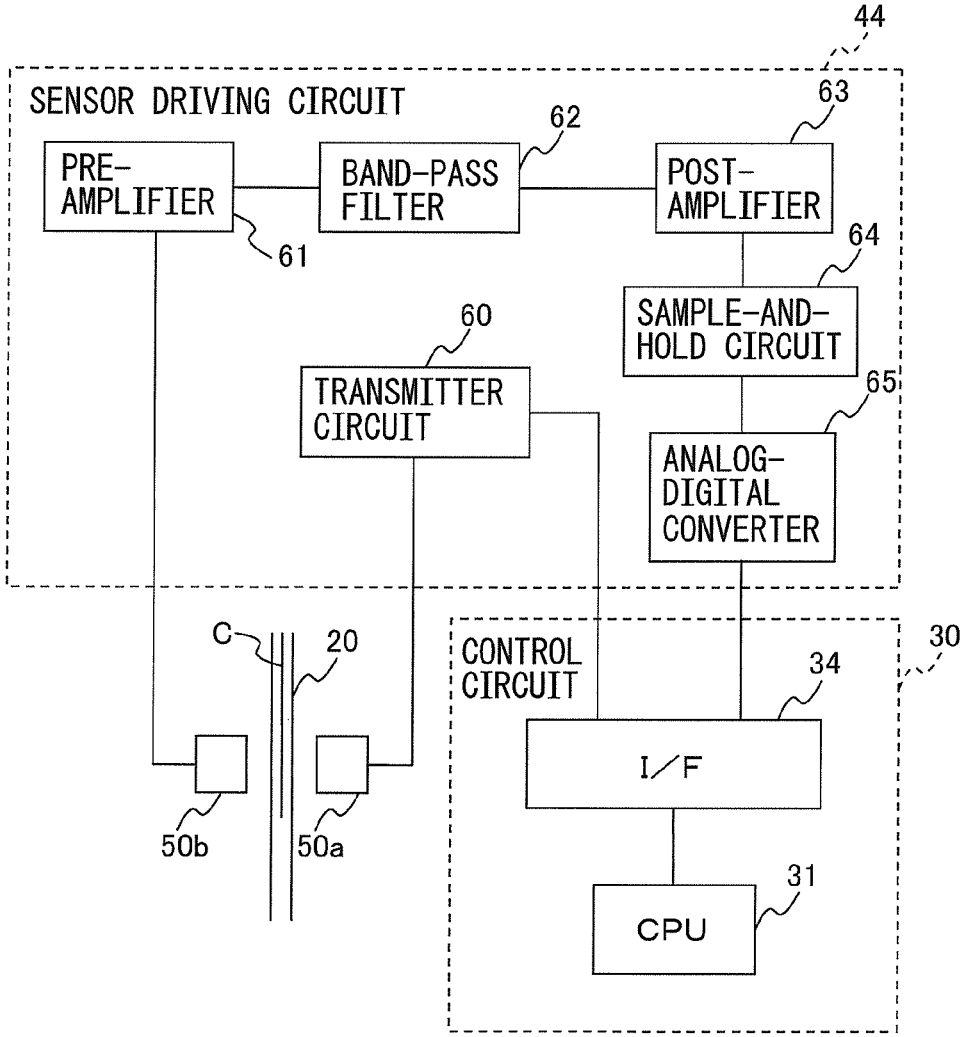
FIG. 3 is a diagram illustrating a configuration example of a sensor driving circuit.

The sensor driving circuit 43 drives the second sensor 51, detects an output signal of the second sensor 51, and supplies it to the control circuit 30. On the other hand, the sensor driving circuit 44 drives the ultrasonic sensor 50, detects an output signal of the ultrasonic sensor 50, and supplies it to the control circuit 30. A configuration example of the sensor driving circuit 44 will be described below with reference to FIG. 3.

The sensor driving circuit 44 includes a transmitter circuit 60, a pre-amplifier 61, a band-pass filter 62, a post-amplifier 63, a sample-and-hold circuit 64, and an analog-digital converter 65. The ultrasonic transmitter 50*a* outputs an ultrasonic wave. The transmitter circuit 60 supplies a drive signal to drive the ultrasonic transmitter 50*a*. The transmitter circuit 60 contains an oscillator circuit which oscillates at a frequency corresponding to the transmitting frequency of the ultrasonic transmitter 50*a*, and the intensity of the ultrasonic wave to be transmitted from the ultrasonic transmitter 50*a* can be adjusted by varying the intensity of the drive signal in accordance with a control signal supplied from the CPU 31.

The ultrasonic receiver 50*b* is disposed on the opposite side of the first transport path 20 from the ultrasonic transmitter 50*a*, and receives the ultrasonic wave transmitted from the ultrasonic transmitter 50*a* and passed through the document C. The ultrasonic receiver 50*b* outputs an electrical signal proportional to the ultrasonic wave received from the ultrasonic transmitter 50*a*. This electrical signal is amplified by the pre-amplifier 61, and unwanted noise contained in the amplified signal is removed by the band-pass filter 62. Then, the signal from which the noise has been removed is amplified by the post-amplifier 63. A peak value of the amplified signal is sampled and held by the sample-and-hold circuit 64, and the sampled peak value is then converted by the analog-digital converter 65 into a digital value.

The CPU 31 receives this digital signal as the output signal S of the ultrasonic sensor 50. The CPU 31 compares the output signal S with a multiple-feed detection threshold Th1 and, if the output signal S is lower than the threshold Th1, then determines that a multiple document feed has occurred.

2. First Embodiment

Various embodiments of the document reading apparatus 1 will be described below. In the first embodiment, a paper thickness detection sensor for detecting the thickness of the document being fed is used as the second sensor 51. Various types of sensors, such as an optical paper thickness sensor, pressure sensor, mechanical sensor, etc., may be used as the paper thickness detection sensor. For example, the optical paper thickness sensor detects the thickness of the document by detecting a change in light reflected from the surface of the document. The pressure sensor detects the pressure that varies according to the thickness of the document. The mechanical sensor detects the amount of displacement of the roller contacting the document.

Based on the output signal of the second sensor 51 which is the paper thickness detection sensor, the CPU 31 discriminates whether the document being fed is a paper document or a card-like document thicker than a paper document. The CPU 31 adjusts the output of the ultrasonic sensor 50 according to the thickness of the document so that the presence or absence of multiple feeding can be determined even when feeding different kinds of documents having different thicknesses. In the following description, a card-like document thicker than a paper document may be referred to as a "card document."

Figure 4A:
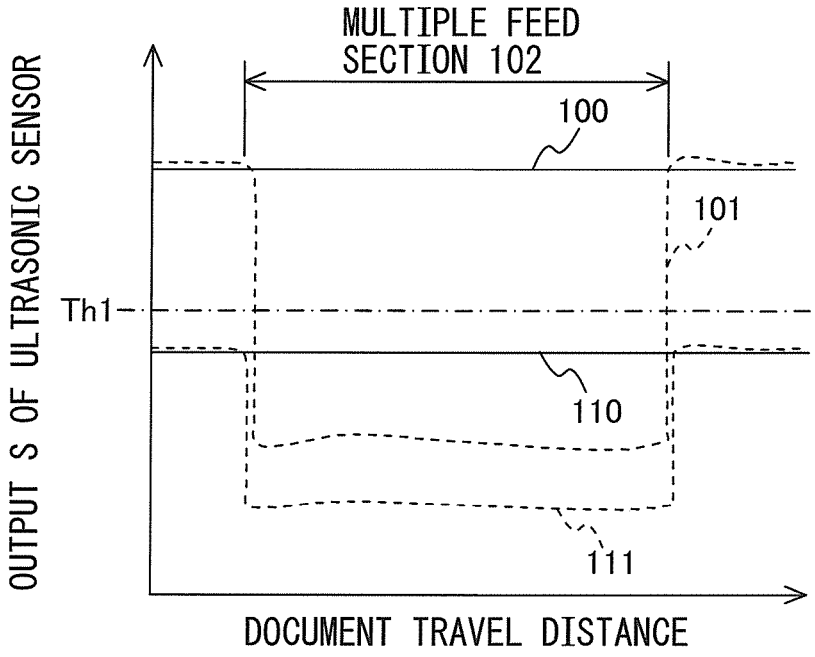
FIG. 4A is diagram illustrating the output characteristics of an ultrasonic sensor under an adjustment condition.
Figure 4B:
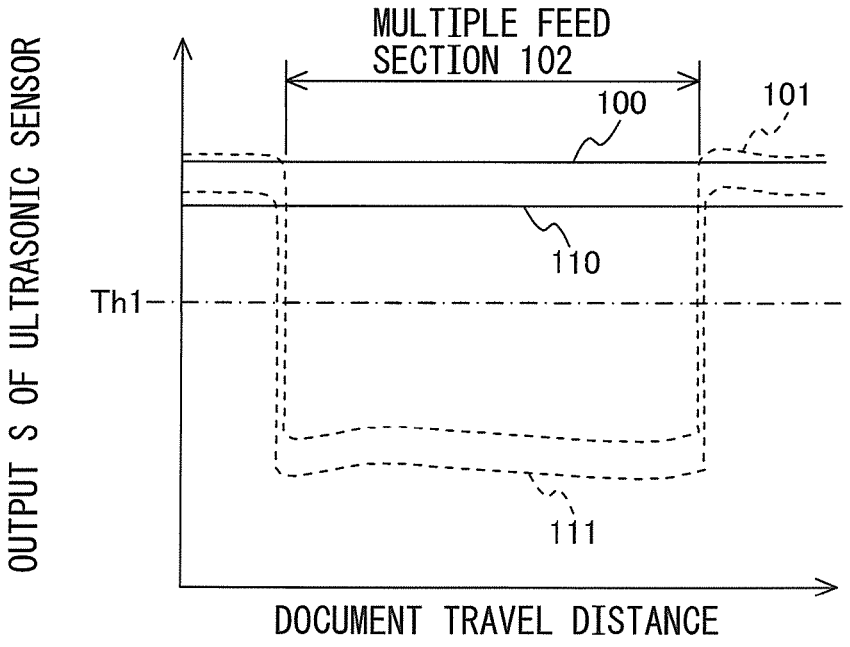
FIG. 4B is diagram illustrating the output characteristics of an ultrasonic sensor under another adjustment condition.

FIGS. 4A and 4B are diagrams illustrating the output characteristics of the ultrasonic sensor 50 under different adjustment conditions. In FIG. 4A, solid line 100 indicates the output characteristic when a single paper document is fed, and dashed line 101 indicates the output characteristic when multiple feeding of paper documents has occurred. The output S of the ultrasonic sensor 50 drops during a section 102 due to the multiple feeding. Accordingly, the CPU 31 can detect the presence or absence of multiple feeding by checking whether the output S of the ultrasonic sensor 50 is lower or not lower than the multiple-feed detection threshold Th1.

Solid line 110 indicates the output characteristic when a single card document is fed, and dashed line 111 indicates the output characteristic when multiple feeding of card documents has occurred. In the case of card documents, the CPU 31 is unable to detect the presence or absence of multiple feeding, because the output S of the ultrasonic sensor 50 is always lower than the multiple-feed detection threshold Th1, irrespective of the presence or absence of multiple feeding.

To address this, when the feeding of a card document(s) is detected by the output signal of the second sensor 51, the CPU 31 adjusts the intensity of the output S of the ultrasonic sensor 50 so that the ultrasonic sensor 50 exhibits the output characteristics as indicated by solid line 110 and dashed line 111 in FIG. 4B for the card documents. The solid line 110 indicates the output characteristic when a single card document is fed, and the dashed line 111 indicates the output characteristic when multiple feeding of card documents has occurred. For reference, solid line 100 and dashed line 101 indicate the output characteristics in the case of paper documents before the output adjustment of the ultrasonic sensor 50. According to the output characteristics depicted in FIG. 4B, the output 110 during the feeding of a single card document exceeds the multiple-feed detection threshold Th1, while the output 111 during the feeding of multiple card documents is lower than the multiple-feed detection threshold Th1. Accordingly, the CPU 31 can detect the presence or absence of multiple feeding even in the case of card documents.

The CPU 31 may adjust the output S of the ultrasonic sensor 50 by varying the intensity of the ultrasonic wave to be transmitted from the ultrasonic transmitter 50*a*. In this case, the CPU 31 adjusts, for example, the intensity of the drive signal that the transmitter circuit 60 outputs. In addition to or instead of this, the CPU 31 may adjust the output S of the ultrasonic sensor 50 by varying the amplification factor for the output signal of the ultrasonic receiver 50*b*. In this case, the CPU 31 adjusts the amplification factor of the pre-amplifier 61 and/or the post-amplifier 63.

Figure 5:
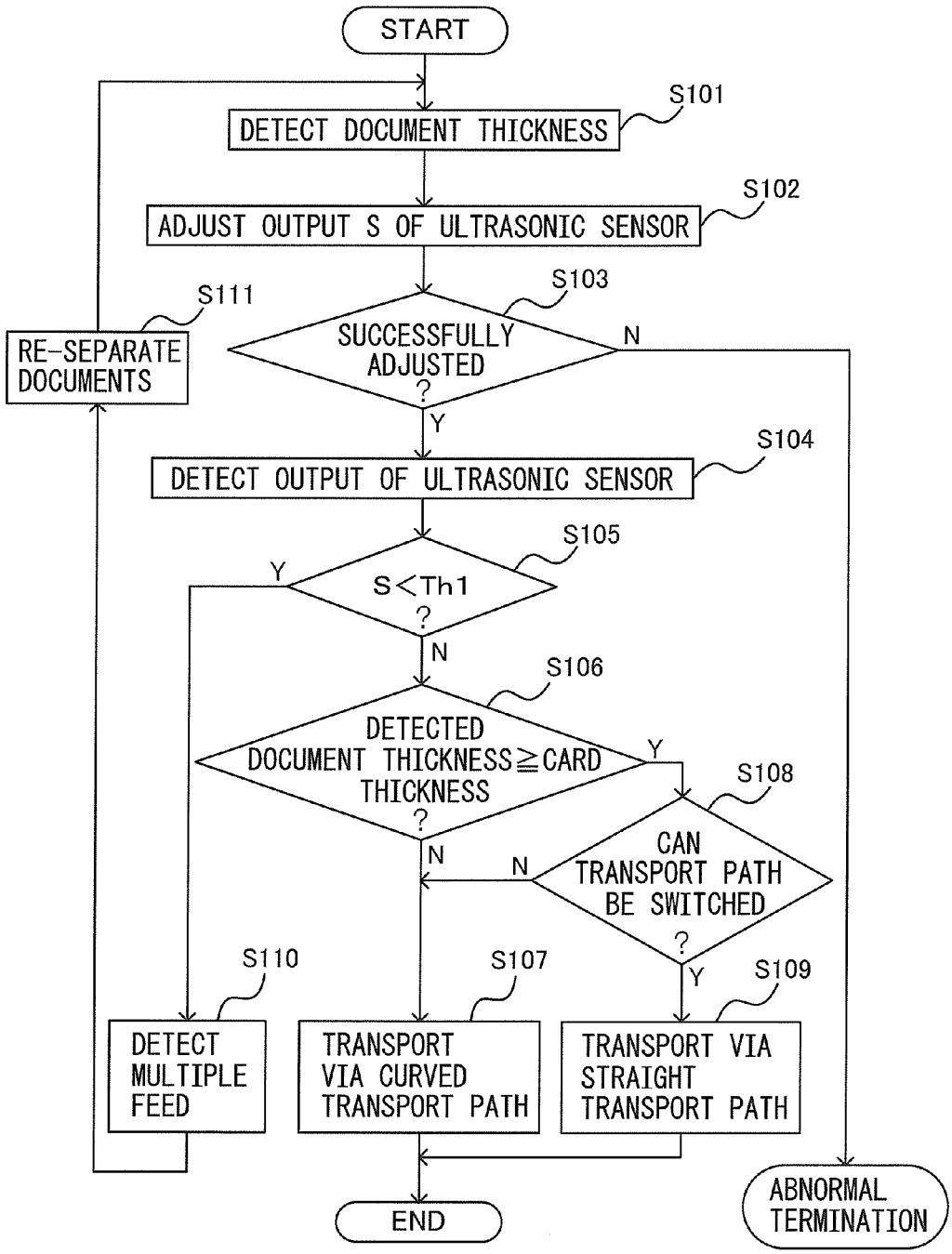
FIG. 5 is a diagram illustrating a first example of multiple feed detection.

Next, the multiple feed detection process according to the first embodiment will be described with reference to FIG. 5. In step S101, the second sensor 51 detects the thickness of the document being fed. In step S102, the CPU 31 adjusts the output S of the ultrasonic sensor 50 according to the thickness of the document. For example, when the document being fed is a card document, the CPU 31 sets the output intensity of the ultrasonic sensor 50 higher than when the document is a paper document.

In step S103, the CPU 31 determines whether the output intensity of the ultrasonic sensor 50 has been successfully adjusted in step S102. If the output intensity has been successfully adjusted (Y in step S103), the process proceeds to step S104. If the output intensity has not been successfully adjusted (N in step S103), the process is abnormally terminated. For example, if the output value of the second sensor 51 exceeds an expected range, it is not possible to adjust the ultrasonic sensor 50 so as to match the output value. In the case of abnormal termination, the CPU produces an alarm to the operator by using the user interface of the document reading apparatus 1.

In step S104, the CPU 31 detects the output S of the ultrasonic sensor 50. In step S105, the CPU 31 determines whether the output S is lower or not lower than the multiple-feed detection threshold Th1. If the output S is lower than the multiple-feed detection threshold Th1 (Y in step S105), the process proceeds to step S110. If the output S is not lower than the multiple-feed detection threshold Th1 (N in step S105), the process proceeds to step S106.

In step S106, the CPU 31 determines whether or not the document thickness detected by the second sensor 51 is equal to or exceeds the card document thickness. If the document thickness is equal to or exceeds the card document thickness (Y in step S106), the process proceeds to step S108. If the document thickness is smaller than the card document thickness (N in step S106), the process proceeds to step S107. In step S107, the CPU 31 operates the path switching unit 23 to select the curved transport path 22 as the transport path for the document. As a result, the paper document is transported along the curved transport path 22 into the second document output tray 4. After that, the process is terminated.

In step S108, the CPU 31 determines whether the transport path for the document can be switched from the curved transport path 22 to the straight transport path 21. For example, the CPU 31 determines whether the transport path can be switched by detecting whether the straight transport path 21 is opened or closed. If the transport path can be switched to the straight transport path 21 (Y in step S108), the process proceeds to S109. If the transport path is unable to be switched (N in step S108), the process proceeds to S107.

In step S109, the CPU 31 operates the path switching unit 23 to switch the transport path for the document from the curved transport path 22 to the straight transport path 21. As a result, the card document is transported along the straight transport path 21 and allowed to output at the first document output tray 3. After that, the process is terminated.

In step S110, the CPU 31 detects the multiple feeding of paper documents or card documents. In step S111, the CPU 31 causes the driving transport roller 13*a* and the separation rollers 12*a* and 12*b* to rotate in the reverse direction, thereby moving the documents back to the position of the separation rollers 12*a* and 12*b*. Then, after the documents have been re-separated, the process returns to step S101.

Figure 6:
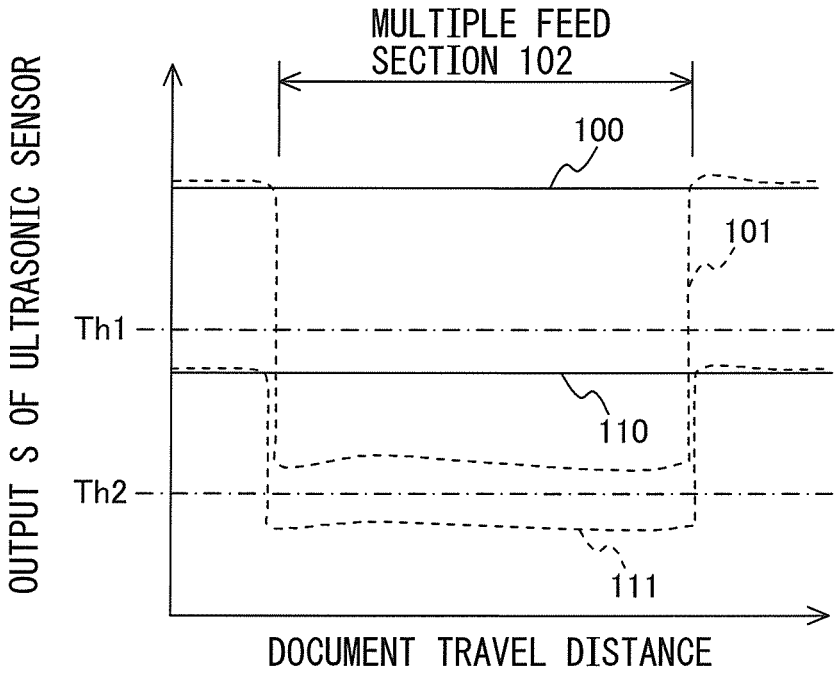
FIG. 6 is a diagram illustrating how a multiple-feed detection threshold is adjusted.

In the above embodiment, the CPU 31 has been described as adjusting the output intensity of the ultrasonic sensor 50 according to the thickness of the document. In addition to or instead of this, the CPU 31 may adjust the multiple-feed detection threshold Th1 according to the thickness of the document. The adjustment of the multiple-feed detection threshold will be described with reference to FIG. 6.

Solid line 100 indicates the output characteristic when a single paper document is fed, and dashed line 101 indicates the output characteristic when multiple feeding of paper documents has occurred. Solid line 110 indicates the output characteristic when a single card document is fed, and dashed line 111 indicates the output characteristic when multiple feeding of card documents has occurred. The CPU 31 uses different multiple-feed detection thresholds Th1 and Th2 for different kinds of documents, the former for the paper document and the latter for the card document. In this way, the CPU 31 adjusts the multiple-feed detection threshold according to the thickness of the document so that the presence or absence of multiple feeding can be determined even when feeding different kinds of documents having different thicknesses.

According to the present embodiment, false detection of multiple feeding can be prevented even when feeding different kinds of documents having different thicknesses. This offers the effect of reducing the chance of incurring document re-separation and re-transportation due to false detection of multiple feeding, and the embodiment can thus increase the throughput of the document transport. Furthermore, in the present embodiment, since the transport path is switched according to the thickness of the document, it is possible to control transport path switching so that card documents difficult to transport through the curved transport path are guided into the straight transport path and other documents are guided into the curved transport path.

3. Second Embodiment

A second embodiment will be described. In the second embodiment, a dimension sensor for detecting the lengths of the sides of the document being transported is used as the second sensor 51. For example, the dimension sensor may detect the dimensions of the document, based on detection signals output from photosensors installed in a plurality of size detection positions. Further, the dimension sensor may be an image sensor for detecting the dimensions of the document by capturing an image of the document. In this case, the image sensor 17 may be configured to also function as the second sensor 51.

Based on the dimensions of the document detected by the second sensor 51, the CPU 31 discriminates whether the document being fed is a paper document or a card document. Card documents, such as driving licenses, identification cards, etc., are in most cases smaller than standardized paper documents. In view of this, the CPU 31 discriminates, based on the dimensions of the document, whether the document being fed is a paper document or a card-like document thicker than a paper document.

If it is determined that the document being fed is a paper document, the CPU 31 enables the multiple feed detection by the ultrasonic sensor 50. Further, the CPU 31 selects the curved transport path 22 as the transport path. On the other hand, if it is determined that the document being fed is a card document, the CPU 31 disables the multiple feed detection by the ultrasonic sensor 50. Further, the CPU 31 selects the straight transport path 21 as the transport path.

Figure 7:
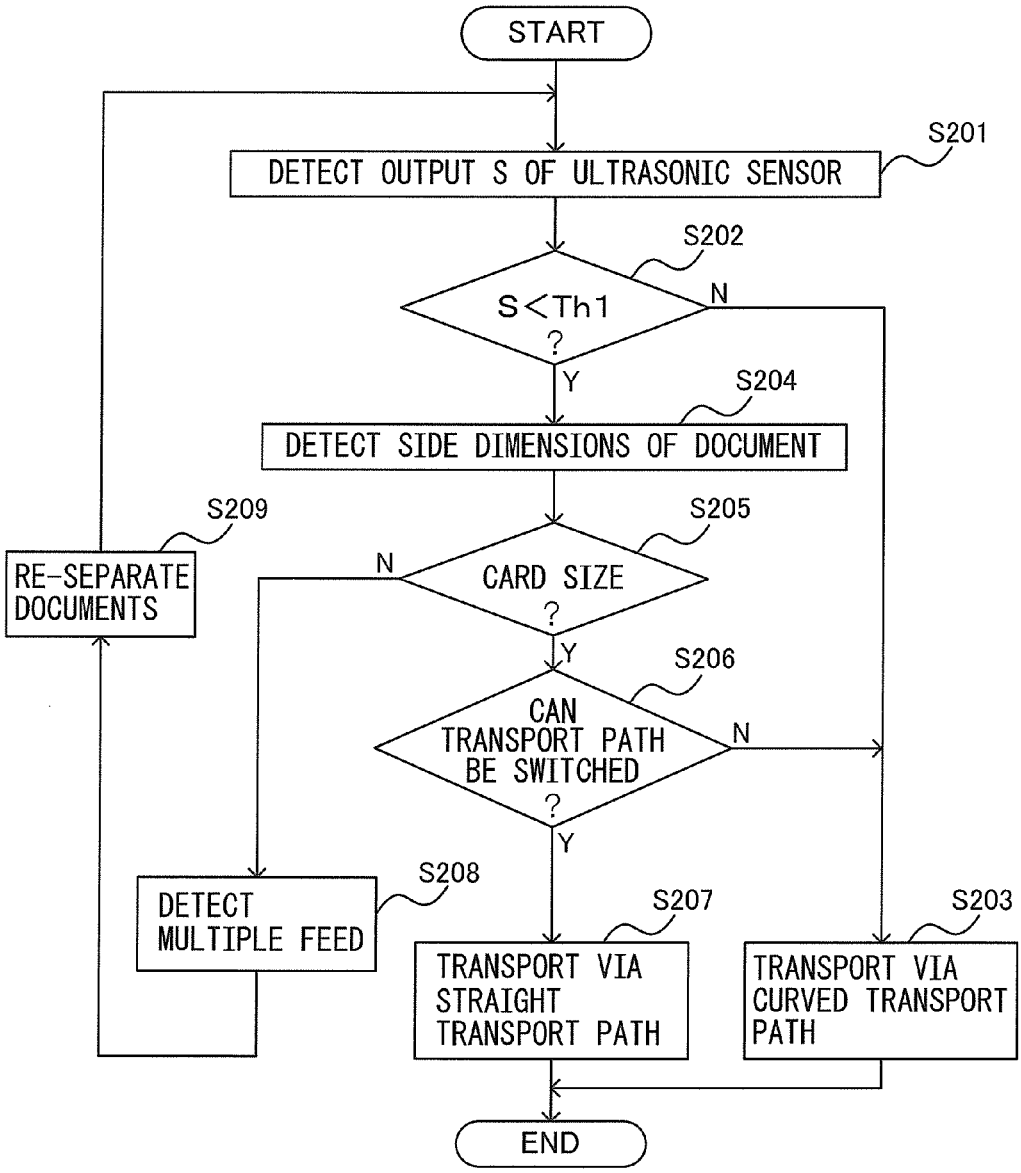
FIG. 7 is a diagram illustrating a second example of multiple feed detection.

Next, the multiple feed detection process according to the second embodiment will be described with reference to FIG. 7. In step S201, the CPU 31 detects the output S of the ultrasonic sensor 50. In step S202, the CPU 31 determines whether the output S is lower or not lower than the multiple-feed detection threshold Th1. If the output S is lower than the multiple-feed detection threshold Th1 (Y in step S202), the process proceeds to step S204. If the output S is not lower than the multiple-feed detection threshold Th1 (N in step S202), the process proceeds to step S203. In step S203, the CPU 31 selects the curved transport path 22 as the transport path for the document. As a result, the paper document is transported along the curved transport path 22 into the second document output tray 4. After that, the process is terminated.

In step S204, the second sensor 51 detects the dimensions of the document being fed. In step S205, the CPU 31 determines whether the document being fed is of a prescribed card size. If the document being fed is of the card size (Y in step S205), the process proceeds to step S206. If the document being fed is not of the card size (N in step S205), the process proceeds to step S208.

In step S206, the CPU 31 determines whether the transport path for the document can be switched from the curved transport path 22 to the straight transport path 21. If the transport path can be switched to the straight transport path 21 (Y in step S206), the process proceeds to S207. If the transport path is unable to be switched (N in step S206), the process proceeds to S203. In S207, the CPU 31 operates the path switching unit 23 to switch the transport path for the document from the curved transport path 22 to the straight transport path 21. As a result, the card document is transported along the straight transport path 21 and allowed to output at the first document output tray 3. In this way, if it is determined that the document being fed is of the card size, the CPU 31 does not perform the multiple document feed detection, regardless of the result of the determination made in step S206. Therefore, when the document being fed is a card document, the multiple feed detection is disabled.

In step S208, the CPU 31 detects the multiple feeding of paper documents. The process of step S209 is the same as the process of step S111 in FIG. 5. After that, the process returns to step S201.

According to the present embodiment, false detection of multiple feeding can be prevented when feeding a card document having different dimensions from a paper document. This offers the effect of reducing the chance of incurring document re-separation and re-transportation due to false detection of multiple feeding, and the embodiment can thus increase the throughput of the document transport. Furthermore, according to the present embodiment, it is possible to control transport path switching so that card documents difficult to transport through the curved transport path are guided into the straight transport path and other documents are guided into the curved transport path. Further, the ultrasonic sensor 50 and the second sensor 51 may be interchanged in position according to how the document reading apparatus 1 is embodied, and the sensor arrangement is not limited to the above specific example. For example, the arrangement of the ultrasonic sensor 50 and the second sensor 51 may be reversed, with the ultrasonic sensor 50 being disposed on the side nearer to the document feed unit 2 and the second sensor 51 on the side nearer to the output trays 3 and 4.

4. Third Embodiment

A third embodiment will be described. In the third embodiment, the second sensor 51 has a structure similar to that of the ultrasonic sensor 50. In the following description, the second sensor 51 is referred to as the "second ultrasonic sensor 51." The CPU 31, based on the detection signal from the second ultrasonic sensor 51, determines whether a single card document is being fed or multiple feeding of paper documents has occurred.

For this purpose, the output characteristic of the second ultrasonic sensor 51 is made different from that of the ultrasonic sensor 50, and the output characteristic is adjusted so that the difference in output value becomes greater between the case in which a single card document is detected and the case in which multiple feeding of paper documents is detected. Further, from the standpoint of preventing interference between the ultrasonic sensor 50 and the second ultrasonic sensor 51, it is preferable to set the ultrasonic transmitting frequency of the second ultrasonic sensor 51 different from that of the ultrasonic sensor 50.

Figure 8A:
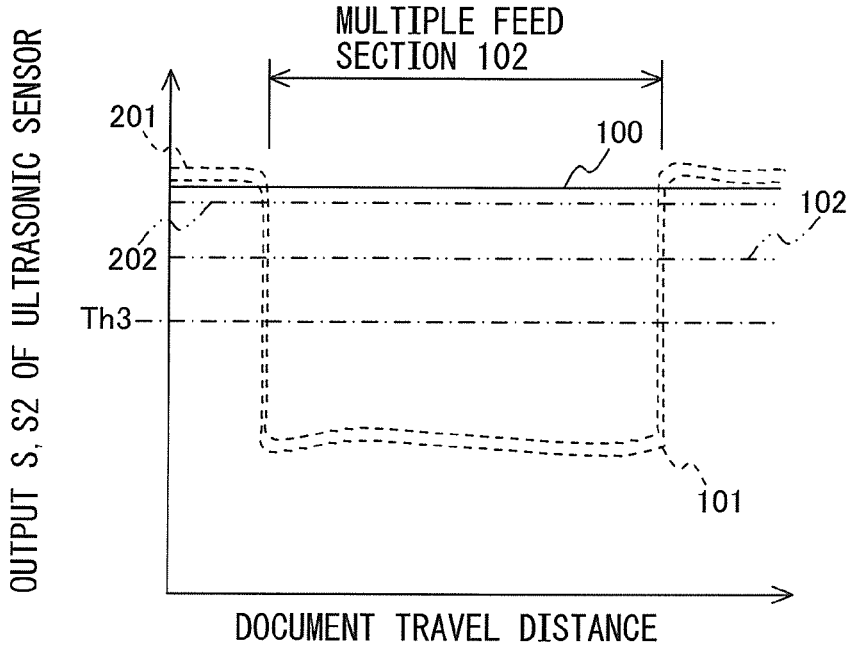
FIG. 8A is diagram illustrating first example, respectively, of the output characteristic of a second ultrasonic sensor.

FIG. 8A is a diagram illustrating a first example of the output characteristic of the second ultrasonic sensor 51. In this example, the ultrasonic transmitting frequency of the second ultrasonic sensor 51 is adjusted. Ultrasonic waves have the property that they are easier to pass through a thick document as their frequency is higher. This means that if the ultrasonic transmitting frequency of the second ultrasonic sensor 51 is adjusted to be lower than that of the ultrasonic sensor 50, the attenuation level due to the presence of a card document becomes smaller. On the other hand, the attenuation that the ultrasonic sensor output suffers during multiple feeding of documents is due to the presence of air layers between the documents. Accordingly, the difference in output that occurs due to the difference in ultrasonic transmitting frequency is smaller in the case of multiple feeding than in the case of the feeding of a single card document. As a result, if the ultrasonic transmitting frequency of the second ultrasonic sensor 51 is set lower than that of the ultrasonic sensor 50, the difference in output value becomes greater between the case of the feeding of a single card document and the case of the multiple feeding of paper documents.

Solid line 100, dashed line 101, and two-dot dashed line 102 indicate the output characteristics of the ultrasonic sensor 50 detected during the feeding of a single paper document, during the multiple feeding of paper documents, and during the feeding of a single card document, respectively. On the other hand, dashed line 201 and two-dot dashed line 202 indicate the output characteristics of the second ultrasonic sensor 51 detected during the multiple feeding of paper documents and during the feeding of a single card document, respectively. Since the ultrasonic transmitting frequency of the second ultrasonic sensor 51 is adjusted to be lower than that of the ultrasonic sensor 50, the attenuation that the output 202 suffers during the feeding of a single card document is smaller than the attenuation that the output 102 of the ultrasonic sensor 50 suffers.

As a result, the difference between the output 202 during the feeding of a single card document and the output 201 during the multiple feeding of paper documents is greater than the difference between the corresponding outputs 102 and 101 of the ultrasonic sensor 50. Accordingly, when distinguishing between the multiple feeding of paper documents and the feeding of the a single card document by comparing the output S2 of the second ultrasonic sensor 51 with a card detection threshold Th3 and by determining whether S2<Th3 or not, it becomes easier to set the card detection threshold Th3, thus serving to increase the accuracy of detection.

Figure 8B:
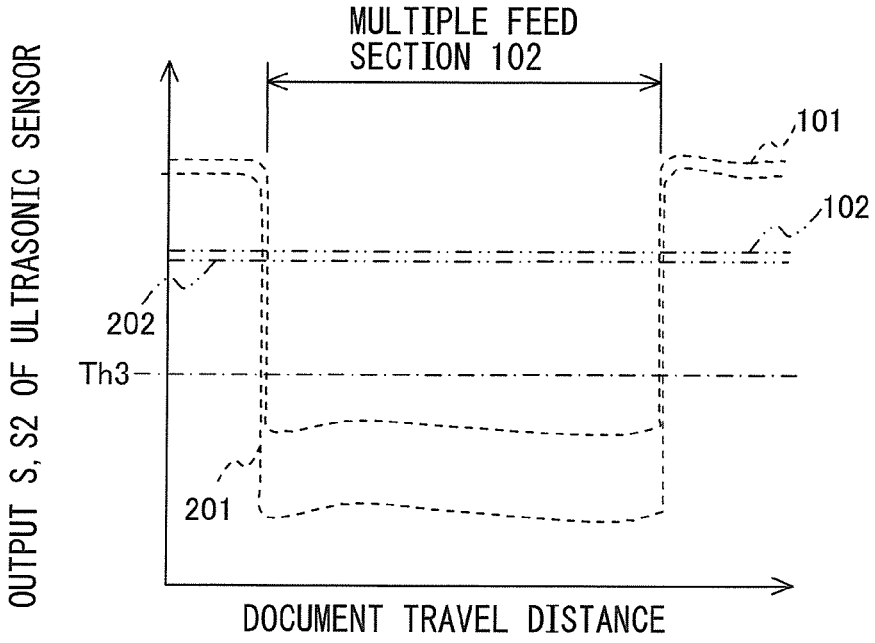
FIG. 8B is diagram illustrating second example, respectively, of the output characteristic of a second ultrasonic sensor.

FIG. 8B is a diagram illustrating a second example of the output characteristic of the second ultrasonic sensor 51. In this example, the angle at which the ultrasonic wave from the second ultrasonic sensor 51 is incident on the document is adjusted. As described above, the attenuation that the ultrasonic sensor output suffers during multiple feeding of documents is due to the presence of air layers between the documents. This means that as the angle at which the ultrasonic wave is incident on the document becomes larger, the amount of attenuation due to multiple document feeding increases because the distance that the ultrasonic wave travels when passing through the documents becomes longer. On the other hand, the difference in attenuation that occurs due to the difference in incidence angle is smaller in the case of a single document than in the case of multiple feeding. As a result, if the angle at which the ultrasonic wave from the second ultrasonic sensor 51 is incident on the document is set larger than that of the ultrasonic sensor 50, the difference in output value becomes greater between the case of the feeding of a single card document and the case of the multiple feeding of paper documents.

Dashed line 101 and two-dot dashed line 102 indicate the output characteristics of the ultrasonic sensor 50 detected during the multiple feeding of paper documents and during the feeding of a single card document, respectively. On the other hand, dashed line 201 and two-dot dashed line 202 indicate the output characteristics of the second ultrasonic sensor 51 detected during the multiple feeding of paper documents and during the feeding of a single card document, respectively. Since the angle at which the ultrasonic wave from the second ultrasonic sensor 51 is incident on the document is adjusted to be larger than that of the ultrasonic sensor 50, the attenuation that the output 201 suffers during multiple feeding is larger than the attenuation that the output 101 of the ultrasonic sensor 50 suffers. As a result, the difference between the output 202 during the feeding of a single card document and the output 201 during the multiple feeding of paper documents becomes greater than the difference between the corresponding outputs 102 and 101 of the ultrasonic sensor 50.

The adjustment that sets the transmitting frequency of the second ultrasonic sensor 51 lower than that of the ultrasonic sensor 50 may be combined with the adjustment that sets the incidence angle of the second ultrasonic sensor 51 larger than that of the ultrasonic sensor 50. Alternatively, only one or the other of the adjustments may be performed.

In a certain embodiment, the transmitting frequency of the ultrasonic sensor 50 is set to 200 kHz, and the transmitting frequency of the second ultrasonic sensor 51 is adjusted to be lower than 200 kHz. In an alternative embodiment, the transmitting frequency of the ultrasonic sensor 50 is set to 300 kHz, and the transmitting frequency of the second ultrasonic sensor 51 is adjusted to be lower than 300 kHz.

Further, in a certain embodiment, the incidence angle of the ultrasonic wave from the ultrasonic sensor 50 is set to 15 degrees, and the incidence angle of the ultrasonic wave from the second ultrasonic sensor 51 is adjusted to be larger than 15 degrees. In an alternative embodiment, the incidence angle of the ultrasonic wave from the ultrasonic sensor 50 is set to 25 degrees, and the incidence angle of the ultrasonic wave from the second ultrasonic sensor 51 is adjusted to be larger than 25 degrees.

The conditions for document type distinction and multiple feed detection, in relation to the outputs of the ultrasonic sensor 50 and the second ultrasonic sensor 51, are summarized in the following table.

TABLE 1

| S | S2 | RESULT OF DISCRIMINATION |
|---|---|---|
| NOT LOWER THAN Th1 | | PAPER DOCUMENT |
| LOWER THAN Th1 | NOT LOWER THAN Th3 | CARD DOCUMENT |
| | LOWER THAN Th3 | MULTIPLE FEEDING |

(1) If the output S of the ultrasonic sensor 50 is not lower than the multiple-feed detection threshold Th1, it is determined that a single paper document is being fed.

(2) If the output S of the ultrasonic sensor 50 is lower than the multiple-feed detection threshold Th1, and if the output S2 of the second ultrasonic sensor 51 is not lower than the card detection threshold Th3, then it is determined that a single card document is being fed.

(3) If the output S of the ultrasonic sensor 50 is lower than the multiple-feed detection threshold Th1, and if the output S2 of the second ultrasonic sensor 51 is lower than the card detection threshold Th3, then it is determined that the multiple feeding of paper documents has occurred.

Figure 9:
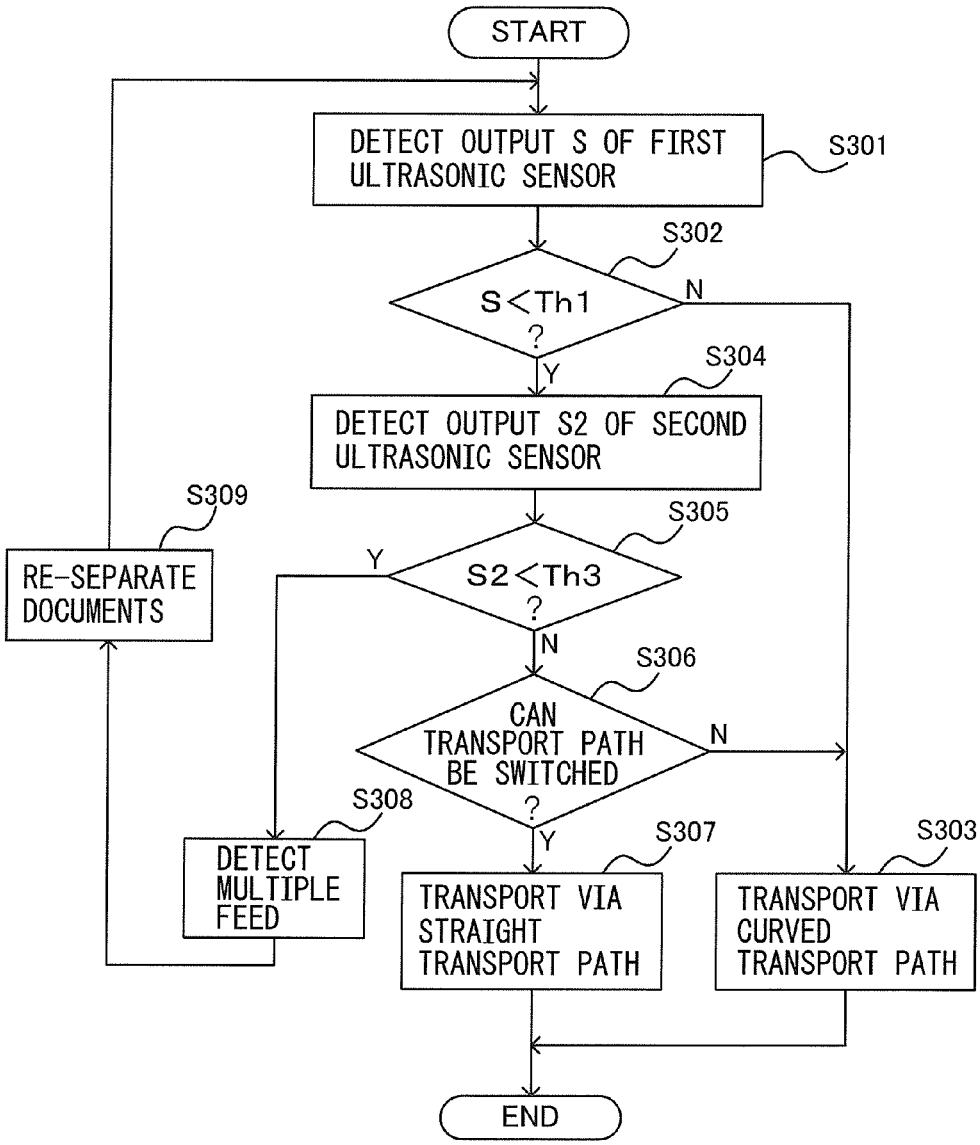
FIG. 9 is a diagram illustrating a third example of multiple feed detection.

Next, the multiple feed detection process according to the third embodiment will be described with reference to FIG. 9. In step S301, the CPU 31 detects the output S of the ultrasonic sensor 50. In step S302, the CPU 31 determines whether the output S is lower or not lower than the multiple-feed detection threshold Th1. If the output S is lower than the multiple-feed detection threshold Th1 (Y in step S302), the process proceeds to step S304. If the output S is not lower than the multiple-feed detection threshold Th1 (N in step S302), the process proceeds to step S303. In step S303, the CPU 31 selects the curved transport path 22 as the transport path for the document. After that, the process is terminated.

In step S304, the CPU 31 detects the output S2 of the second ultrasonic sensor 51. In step S305, the CPU 31 determines whether the output S2 is lower or not lower than the card detection threshold Th3. If the output S2 is lower than the card detection threshold Th3 (Y in step S305), the process proceeds to step S308. If the output S2 is not lower than the card detection threshold Th3 (N in step S305), the process proceeds to step S306.

In step S306, the CPU 31 determines whether the transport path for the document can be switched from the curved transport path 22 to the straight transport path 21. If the transport path can be switched to the straight transport path 21 (Y in step S306), the process proceeds to S307. If the transport path is unable to be switched (N in step S306), the process proceeds to S303. In S307, the CPU 31 operates the path switching unit 23 to switch the transport path for the document from the curved transport path 22 to the straight transport path 21. When it is determined that the document being fed is a card document, the CPU 31 disables the multiple document feed detection, regardless of the result of the determination made in step S306.

In step S308, the CPU 31 detects the multiple feeding of paper documents. The process of step S309 is the same as the process of step S111 in FIG. 5. After that, the process returns to step S301.

According to the present embodiment, false detection of multiple feeding can be prevented when feeding paper documents and card documents. This offers the effect of reducing the chance of incurring document re-separation and re-transportation due to false detection of multiple feeding, and the embodiment can thus increase the throughput of the document transport. Furthermore, according to the present embodiment, it becomes possible to control transport path switching so that card documents difficult to transport through the curved transport path are guided into the straight transport path and other documents are guided into the curved transport path.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiment(s) of the present inventions have been described in detail, it should be understood that the various changes, substitutions, and alterations could be made hereto without departing from the spirit and scope of the invention.

What is claimed is:

1. A sheet transport apparatus comprising:

an ultrasonic sensor including an ultrasonic transmitter and an ultrasonic receiver disposed opposite each other across a sheet transport path;

a type detector for discriminating between a first sheet and a second sheet thicker than said first sheet, when the first sheet or the second sheet is being fed along said transport path; and a multiple feed detector for detecting the presence, or absence of multiple feeding of sheets along said transport path, based on an output produced by said ultrasonic sensor and criteria for the output, the criteria being different depending on a detection result supplied from said type detector.

2. The sheet transport apparatus according to claim 1, wherein when said sheet being fed along said transport path is said second sheet, said multiple feed detector does not detect the feeding of said second sheet as being an occurrence of multiple feeding of first sheets.

3. The sheet transport apparatus according to claim 1, further comprising:

a first output path for outputting said first sheet;

a second output path for outputting said second sheet; and a path switch for selecting said first output path or said second output path as the output path for said sheet being fed along said transport path, based on the detection result from said type detector.

4. The sheet transport apparatus according to claim 1, wherein said type detector includes a thickness detection sensor configured to detect a thickness of said first or second sheet being fed along said transport path.

5. The sheet transport apparatus according to claim 4, wherein said multiple feed detector includes an output adjuster which adjusts the output of said ultrasonic sensor based on a detection result supplied from said thickness detection sensor.

6. The sheet transport apparatus according to claim 1, wherein said type detector includes:

a dimension sensor for detecting a side dimension of said first or second sheet being fed along said transport path; and a distinguish unit for distinguishing between said first sheet and said second sheet, based on a difference between the side dimension of said first sheet and the side dimension of said second sheet.

7. The sheet transport apparatus according to claim 1, wherein said type detector includes a second ultrasonic sensor provided separately from said ultrasonic sensor and including an ultrasonic transmitter and an ultrasonic receiver disposed opposite each other so as to sandwich said transport path therebetween, and wherein said ultrasonic sensor and said second ultrasonic sensor have different output attenuation characteristics and respond differently to the thickness of said first or second sheet present between said ultrasonic transmitter and said ultrasonic receiver or to the presence or absence of multiple feeding of sheets.

8. The sheet transport apparatus according to claim 1, further comprising:

a feeder for feeding said sheet;

a separator for separating a plurality of sheets fed from said feeder and supplying one sheet at a time into said transport path; and a transport controller for moving said sheets back to said separator and have said sheets re-separated, upon detection of said multiple feeding.

9. A sheet transport method comprising:

detecting an output of an ultrasonic sensor;

distinguishing a type of a sheet being fed along said transport path, by a detector which discriminates between a first sheet and a second sheet thicker than said first sheet, when the first sheet or the second sheet is being fed along said transport path; and detecting the presence or absence of multiple feeding of sheets along said transport path, based on the output of said ultrasonic sensor and criteria for the output, the criteria being different depending on a distinction result supplied from said type detector.

* * * * *